United States Patent [19]

Beck

[11] 4,015,756

[45] Apr. 5, 1977

[54] SPOUT FOR SWIVEL-SPOUT DISPENSING CLOSURES

[75] Inventor: James M. Beck, Carol Stream, Ill.

[73] Assignee: U.S. Cap & Closure, Inc., Chicago, Ill.

[22] Filed: Oct. 10, 1975

[21] Appl. No.: 621,429

Related U.S. Application Data

[63] Continuation-in-part of Ser. No. 414,262, Nov. 9, 1973, abandoned.

[52] U.S. Cl. ..... 222/534; 222/536

[51] Int. Cl.[2] ..... B67D 3/00

[58] Field of Search ..... 222/536, 534, 533, 566, 222/567

[56] References Cited

UNITED STATES PATENTS

| | | | |
|---|---|---|---|
| 3,265,256 | 8/1966 | Chaber et al. | 222/534 |
| 3,502,248 | 3/1970 | Libit et al. | 222/536 X |
| 3,734,359 | 5/1973 | Waterman | 222/534 X |

*Primary Examiner*—Robert B. Reeves
*Assistant Examiner*—John P. Shannon

[57] ABSTRACT

An improved spout for a dispensing closure of the swivel-spout type for use with a container for fluent substances has a hollow cylindrical knuckle received with a snap fit in mating bearing openings in a base for rotatable relation therewith to position the spout between "on" and "off" positions. A hollow nozzle intersects the knuckle wall. The knuckle has sealing and sliding contact with pads on the base and with a protuberant ring circumjacent a passage in the base for exit of the contents of the container through the bore of the nozzle when the spout is in the "on" position.

6 Claims, 5 Drawing Figures

SPOUT FOR SWIVEL-SPOUT DISPENSING CLOSURES

This application is a continuation-in-part application of Ser. No. 414,262, filed Nov. 9, 1973, now abandoned.

BACKGROUND OF THE INVENTION

The spout, as understood in this industry, is the entire rotatable part of a two swivel-spout dispensing closure. For clarity of description applicant has chosen to define this spout as comprising a knuckle and a nozzle extending outwardly therefrom.

Dispensing closures of the type to which the invention relates generally comprise a pivotal cylindrical knuckle with a nozzle extending therefrom and a base with which it is associated for swiveling movement. These are of a resilient, but generally shape-retaining material, e.g. polyethylene or polypropylene, which enables the knuckle at the inner end of the nozzle to be snapped into a substantially matching cavity in the base, the cavity wall having an arc greater than 180°. In a preferred form the base is polypropylene and the spout is polyethylene. In any case, these parts must be so constructed and arranged that leakage is to be avoided.

Closures of the type herein discussed are molded in production quantities, and the two parts are assembled by automatic machinery. The bearing openings in which the knuckle rotates necessitate re-entrant portions in the base mold so that, when the core is "pulled" following casting, it is inevitable that slight departures from established tolerances may be expected. When this occurs, the manufacturer has what are termed in this industry as "leakers," by reason of the knuckle not sealing properly with respect to the base. That is to say, what was intended to be a reliable fit of the knuckle in its bearing openings then turns out to be less than perfect, with consequent rejection at the manufacturing or customer level. Heretofore, the attainment of this paramount objective left much to be desired. Even the provision of a protuberant, restricted area, such as a ring or pad, between the two parts to achieve high contact pressure per unit area has not resulted in adequate sealing. If the pads retaining the knuckle should apply too much force normal to the surfaces in contact in the neighborhood of the fluid passages through the base and spout, the resulting friction renders manipulation difficult and, if too little force, leakage occurs. This problem is minimal in the case of viscous fluids but is of considerable significance in the case of volatile fluids such as naphtha.

Prior to the present invention, U.S. Pat. Nos. 3,111,245 and 3,502,248 disclosed spouts which attempted to resolve the conflict between ease of movement and maintenance of the necessary seal U.S. Pat. No. 3,502,248 relies on several pads to support a solid cylindrical knuckle. Although the knuckle of U.S. Pat. No. 3,502,248 is supported on a plurality of pads, these latter are all tangent to the knuckle and, therefore, in the interest of conciseness, may be considered jointly as a cylindrical surface and the surface of the knuckle as a surface complementary therewith.

SUMMARY OF THE INVENTION

To cure this problem the applicant provides for a hollow, cylindrical knuckle instead of the solid cylinder of the prior art. In this way and considering the resilient nature of the plastic, the knuckle may deform to accommodate itself to those portions of the base with which it has a rotatable relationship. No such feature is known in the prior art.

The present invention has for its principal object increasing the deformability of the knuckle in order that it may sealingly accommodate to the several surfaces of the base with which it is in contact in its range of movement but maintain strength in the spout for pivotal movements. Desirably this end is reached by means of a knuckle of hollow, cylindrical form which will not detract from smooth rotation of the spout but will improve the seal between the two parts, together with a nozzle of hollow, cylindrical form which intersects the walls of the knuckle thereby strengthening the hollow knuckle. Further, this modification of the knuckle results in lower material cost.

BRIEF DESCRIPTION OF THE DRAWINGS

The present invention is shown in the following drawings as one illustrative embodiment of the principles underlying the invention.

DESCRIPTION OF THE PREFERRED EMBODIMENT

Figure 1:
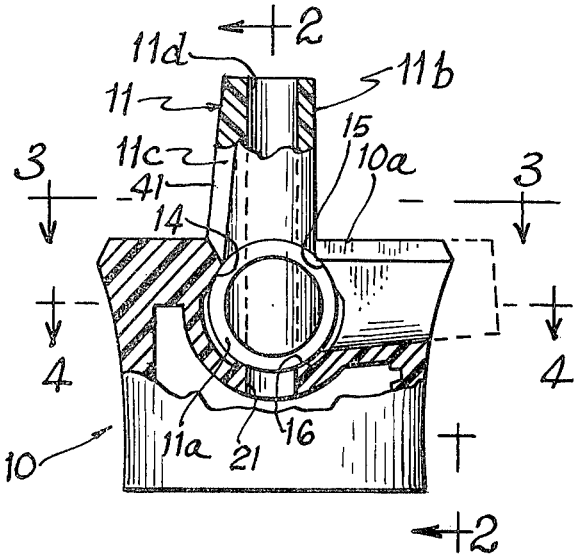
FIG. 1 is a combined side elevation and cross-section of a dispensing closure incorporating a spout in accordance with the invention.

Adverting to the drawing, the closure of the illustrated embodiment comprises a base 10 and a spout 11, both comprising a resilient, but generally shape-retaining material such as polyethylene. However, the base is preferably made more rigid than the spout by the use of a material such as polypropylene.

The base 10 may take any well-known form known in the art in connection with swivel-spout dispensing closures and will include some means to attach the same to the container, e.g. screw-threads, as shown.

The spout 11 comprises a cylindrical, hollow knuckle **11*a* and a nozzle 11*b* extending radially outwardly therethrough and therefrom. The knuckle is received in the base with a snap fit as previously described. The areas of contact and retention of the knuckle with respect to the base are indicated typically as pads 14, 15 and 16. The pads 14 and 15 contact the knuckle at points which are more than 180° apart measured about the axis of rotation in order that the spout may be assembled with the base with a snap fit. The pad 16 surrounds the passage 21 in the base through which the contents of the container pass into the nozzle 11*b*** and thus is designed to precluse leakage.

In the "off" position, the nozzle **11*b* is received in a branch cavity 23 and the outer surface 11*c* of the nozzle is then flush with the upper surface 10*a*** of the base. However, this flush relation, while common in the art, is not essential since swivel-type dispensing closures are known wherein the nozzle, in the "off" position, protrudes beyond the adjacent surfaces of the base.

In general, the pads 14, 15 and 16 are tangent to or are concentric with a curved plane substantially concentric with the knuckle 11 and may be regarded as defining a substantially cylindrical cavity which, for convenience, is referred to as a principal cavity, and the cavity 23 which branches therefrom may be termed a subsidiary cavity. However, as mentioned above, this latter may or may not co-exist with the improved knuckle of the present invention.

The knuckle 11*a* is restrained against axial shifting by abutment of the end faces 31—31 thereof with respective surfaces 32 serving as the end walls of the substantially cylindrical cavity 23.

Figure 2:
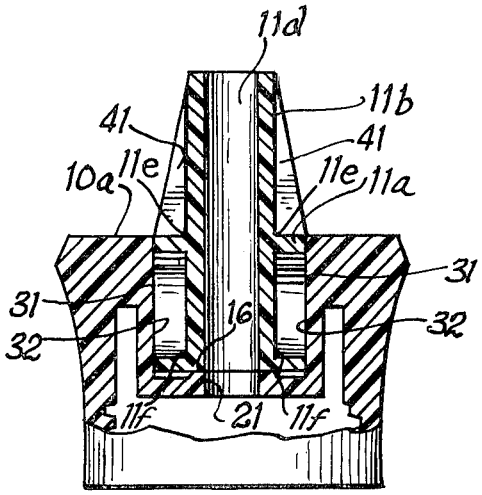
FIG. 2 is a cross-section on the line 2—2 of FIG. 1.

Referring particularly to the spout, it will be observed that the nozzle 11*b* is also a hollow cylinder with the bore 11*d* thereof serving as a passage for exit of the contact of the container. Further in FIG. 2 it will be seen that, in the "on" position, the bore 11*d* registers with the opening 21 and, in the "off" position the bore and opening are out of register.

Figure 4:
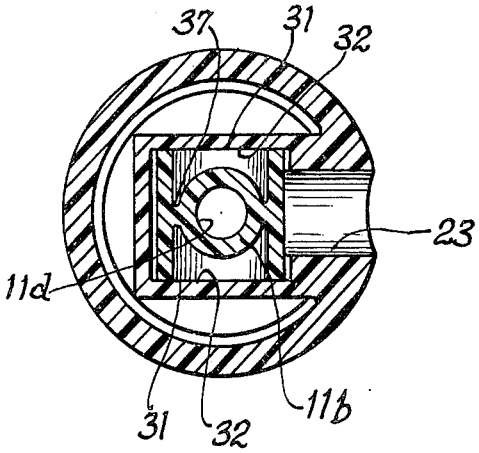
FIG. 4 is a cross-section on the line 4—4 of FIG. 1.
Figure 5:
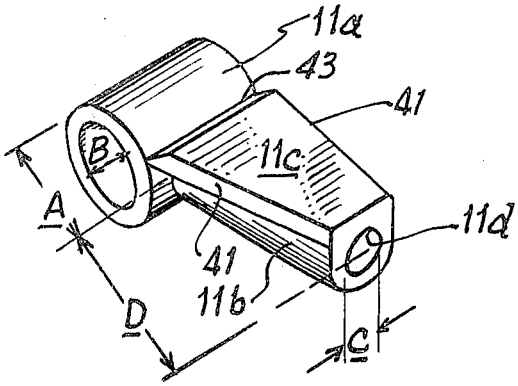
FIG. 5 is a perspective view of the spout standing alone.

The nozzle 11 intersects the wall of the knuckle 11*a* at 11*e* and 11*f*. In addition to intersecting the wall of the knuckle the nozzle passes through the interior of the knuckle thereby strengthening the knuckle wall in this portion to which the force necessary to pivot the spout is applied. Additional strength is provided to the knuckle by forming suitable web-like fillets 37, FIG. 4, between the exterior wall of the nozzle within the knuckle and the interior wall of the knuckle adjacent thereto. These fillets should have a thickness which allows them to deform slightly when the knuckle is snapped into the cavity and then regain their web-like form after the insertion. By so doing, fabrication of the molds is simplified and the hazard of stress cracking is alleviated.

Figure 3:
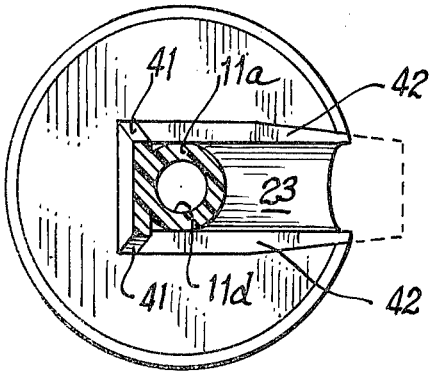
FIG. 3 is a cross-section on the line 3—3 of FIG. 1.

To provide esthetic, flush relation between the spout and base the spout may be provided with wings 41—41 adapted to seat in respective mating recesses 42—42 in flush relation. The intersection of the wings 41—41 with the knuckle along lines 43 provides additional strength to the knuckle wall. The closed position of the spout is indicated by broken lines (FIGS. 1 and 3), and the distal end of spout overhangs the base, as shown, to accept a finger or thumb for manipulation of the spout to open position.

It will be observed that the knuckle 11*a* is hollowed out to the maximum degree, subject to the intersecting nozzle 11*b* and to the preservation of adequate stiffness of the knuckle portions on each side of the nozzle. That is to say, too little lightening of the knuckle may not result in any appreciable saving of material and reduction of weight, while too much will render the knuckle subject to deforming forces from which it may not regain its proper shape to provide sealing. Bearing in mind that the preferred material for the spout is polyethylene, which is a resilient material which retains its shape after deformation, too thin a wall for the nozzle and the knuckle will allow the cylindrical form of the knuckle to be deformed readily as the spout 11 is shifted about the pads 14, 15 and 16 between its two positions. Consequently, relatively effortless shifting is precluded. Moreover, too thin a wall will result in weaving of the wall of the cylindrical shell constituting the knuckle 11*a*. Obviously, suitable compromise between these several factors will be reached more or less empirically, depending upon the geometry, tolerances and kind of plastic composition.

It must also be emphasized that, by providing a suitably thin-walled knuckle, the same may accommodate readily to irregularities in the base which may interfere with proper operation, e.g. irregularities in the face 16 of the sealing ring and yet maintain a seal. Additionally, a sealing snap-fit assembly of the two parts of the closure, by forcing the knuckle past the pads 14 and 15, is facilitated, since the wall of the knuckle will deform to the degree necessary to be pushed past the pads into the cavity to enable snapping the same into operative position with less force and then regain its cylindrical form after the insertion into the cavity.

In a preferred embodiment utilizing a polypropylene base and a polyethylene spout, dimensions were as follows:

Knuckle, A = 0.480 inches, B = 0.360 inch.

Nozzle, C = 0.300 inch, D = 0.625 inch approx.

In a modified form provision may be made for two bores through the spout and corresponding respective openings through the base to register with these bores. Thus, pouring may be accomplished through one registering set thereof and venting through the other set.

In the illustrative embodiment a diametrical longitudinal plane of the nozzle is coincident with a diametrical longitudinal plane of the knuckle. It will be understood that these planes may be offset from one another without lessening the strength imparted to the knuckle by the inserting nozzle.

I claim:

1. In the combination of a container and a dispensing closure having a base and a swivel-spout mounted in the top of said base, at least one of said base and said swivel spout being of a resilient but generally shape retaining material, the base being adapted to be attached to a container for flowable material, the spout having a nozzle connected to a cylindrical knuckle pivotally engaged by a "snap fit" with a plurality of complementary bearing openings in the base, a portion of said openings coacting with the outer surface of said knuckle in sealing relationship, said spout being adapted for pivotal movement between "on" and "off" positions to permit flow of the material and interruption thereof respectively, a bore in said nozzle extending through the knuckle, passage means in said base adapted to provide fluid communication between the interior of said container and said spout, said bore, when registered with said passage through the base by said pivotal movement to the "on" position providing fluid communication between the interior of the container and the exit end of the bore, an improvement in the spout in which said spout comprises first and second hollow cylinders, the first cylinder forming the knuckle with a wall of resilient but generally shape retaining material which will deform to the degree necessary when said knuckle is inserted into said bearing openings with a "snap fit" and regain its cylindrical form after said insertion, said second hollow cylinder forming said nozzle with said bore and arranged at right angles to said first hollow cylinder and extending through the wall and interior of said first hollow cylinder to provide communication between said bore and said passage in said base, diametrically positioned web-like means connecting the outer surfaces of the portion of said second cylinder lying within the first cylinder with the adjacent inner surfaces of the first cylinder, the web-like means and the portion of said second cylinder within said first cylinder coacting to strengthen the wall portions of said first cylinder containing said second cylinder to which a force necessary to pivot the spout is applied, the remaining hollow wall portions of said first cylinder on each side of said second cylinder remaining resilient.

2. The combination in accordance with claim 1 further characterized in that the top of the base is provided with a cavity branching from the bearing openings to receive the nozzle in substantially flush relation with the base when the spout is pivoted to the "off" position.

3. The combination in accordance with claim 2 wherein the nozzle of the spout is provided with a pair of laterally extending wings, the members of the pair being in co-planar relation, and the branch cavity having recesses to receive respective ones of said wings in flush relation.

4. The combination in accordance with claim 1 wherein the longitudinal axis of said nozzle lies in substantially the same plane as the longitudinal axis of the knuckle and is perpendicular thereto.

5. The combination in accordance with claim 3 wherein the nozzle wings extend to and merge with the wall of the knuckle.

6. A spout adapted to be assembled with the base of a dispensing closure of the swivel-spout type, at least one of said base and said swivel-spout being of a resilient generally shape retaining material, said spout including male pivot means and nozzle means, said base having an opening in the top thereof of substantially cylindrical form, the curved surface of which opening extends for more than 180° to define a cavity into which the male pivot means may be forced with snap action to be received in pivotal relation with the base, a plurality of complementary bearings formed on the surface of said cavity, a portion of said bearings coacting with the outer surface of said male pivot means in sealing relationship, said pivot means comprising material which is resilient but generally shape retaining and being constituted as a first hollow cylinder having a wall which will deform to the degree necessary when said pivot means is forced into said cavity with a "snap fit" and regain its cylindrical form after entry into said cavity so as to provide pivotal and resilient sealing engagement between said pivot means and said portion of said bearings, said nozzle means comprising a second hollow cylinder of said resilient material which is positioned at right angles to said first hollow cylinder and extends through the wall and interior of said first hollow cylinder to provide communication between said nozzle and a passage in said base when said pivot means is pivoted in said cavity to register with said passage in said base, diametrically positioned web-like means connecting the outer surfaces of the portion of said second cylinder lying within the first cylinder with the adjacent inner surfaces of the first cylinder, the web-like means and the portion of said second cylinder within said first cylinder coacting to strengthen the wall portions of said first cylinder containing said second cylinder to which a force necessary to pivot the spout is applied, the remaining hollow wall portions of said first cylinder on each side of said second cylinder remaining resilient.

* * * * *

UNITED STATES PATENT OFFICE

CERTIFICATE OF CORRECTION

Patent No. 4,015,756 Dated April 5, 1977

Inventor(s) James M. Beck

It is certified that error appears in the above-identified patent and that said Letters Patent are hereby corrected as shown below:

Column 1, line 11, "two" should read -- two part --.

Column 3, line 14, "contact" should read -- contents

Column 4, line 24, "inserting" should read -- intersecting --.

Signed and Sealed this

*Eighteenth* Day of *April 1978*

[SEAL]

*Attest:*

RUTH C. MASON
*Attesting Officer*

LUTRELLE F. PARKER
*Acting Commissioner of Patents and Trademarks*